United States Patent [19]

Rotthaus

[11] 4,307,269

[45] Dec. 22, 1981

[54] SWITCH APPARATUS FOR ACTIVATING SWITCH CONTACTS

[75] Inventor: Dirk Rotthaus, Bochum, Fed. Rep. of Germany

[73] Assignee: Mannesmann DeMag AG, Duisburg, Fed. Rep. of Germany

[21] Appl. No.: 100,010

[22] Filed: Dec. 4, 1979

[30] Foreign Application Priority Data

Dec. 8, 1979 [DE] Fed. Rep. of Germany ..... 2904681

[51] Int. Cl.[3] ..... H01H 3/00

[52] U.S. Cl. ..... 200/30 R; 200/47; 200/153 LB

[58] Field of Search ..... 200/30 R, 153 L, 153 LB, 200/153 G, 217, 218, 47, 17 R, 18

[56] References Cited

U.S. PATENT DOCUMENTS 2,389,350 11/1945 Exner ..... 200/47

FOREIGN PATENT DOCUMENTS 196116 1/1907 Fed. Rep. of Germany .

2135837 7/1972 Fed. Rep. of Germany .

2347581 3/1978 Fed. Rep. of Germany .

*Primary Examiner*—J. V. Truhe

*Assistant Examiner*—Morris Ginsburg

*Attorney, Agent, or Firm*—Mandeville and Schweitzer

[57] ABSTRACT

Apparatus is provided for the positive activation of a switching device operated to function after a predetermined number of revolutions of a drive shaft to deactivate a drive prior to the apparatus reaching a stopping point, such as in finishing machines. Two camshafts are provided, with one driven slowly and one driven rapidly through appropriate gearing from the drive shaft of the apparatus. One or more cams are spaced on each camshaft with the slow cams having a short actuating surface and the fast cams having a long activating surface. Each slow and fast activating surface engages, respectively, one end of a toggle lever, which in turn moves a thrust rod to open the switch. Each toggle lever must be engaged simultaneously with a short and a long activating surface to activate the switch.

9 Claims, 2 Drawing Figures

SWITCH APPARATUS FOR ACTIVATING SWITCH CONTACTS

BACKGROUND AND DESCRIPTION OF THE INVENTION

The invention relates to a switch apparatus for activating switch contacts after a predetermined number of revolutions of a drive shaft which engages at least two cam discs provided with switch points and arranged on camshafts, via gear pinions. The cam discs activate a switch contact when they are in a certain position to each other.

In a previously disclosed switch apparatus, in German DE-AS 23 47 581, the position of the cam discs relative to one another is changed by means of a different number of teeth of its gear pinions. Since the peripheral extent of the teeth is short, the switch period is also short. Thus, there is the risk that the switch period will not be sufficient to effect the switch process reliably. An extension of the switch points in peripheral direction is not possible, as they still partially overlap in two successive revolutions, so that a failure in switching results.

It is the object of the invention to provide a switch apparatus to activate switch contacts after a predetermined number of revolutions of a drive shaft in such a way that the switching can be done reliably, and that the switch period is long enough to have the switch order carried out safely. Such type of apparatus is required, for example, in hoists, finishing machines and the like, in order to effect switching on or off depending upon a distance of travel before reaching terminal stops.

This is achieved by having the camshafts correspond with each other via a transmission gearing, and by having the switch points of both cam discs affect a toggle or rocker lever which may be raised and lowered as well as tilted. The toggle or rocker lever is connected to the switch contacts by means of a thrust rod and, under certain circumstances, a tappet. The slowly revolving cam disc has a rest surface, and the fast revolving cam disc has a switch surface of sufficient length of, perhaps 45° centri-angle to accomplish the switching within the necessary switch period. Only if the toggle lever is kept in switching position by the rest surface and the switch surface simultaneously, can the switching process take place.

After another revolution of the fast revolving cam disc, the rest position of the slowly revolving cam disc is no longer under the toggle lever, which is then only raised on one end by the switch surface of the fast-revolving cam disc, which does not lead to an effective displacement of the switch contacts. The cam discs have limit surfaces, and the toggle lever may have cam followers and be charged by means of a spring towards the cam discs. It presses mainly on the slowly revolving cam disc. When the switch contacts are closed there is an intermediate space between the thrust rod and the tappet of the switch contacts permitting an ineffective pendulum-like swing of the toggle lever with only one side of the lever raised.

The transmission gearing of the switch apparatus meets the requirements and has, for example, a transmission ratio of 20:1. With this difference, it drives the parallel camshafts with the cam discs arranged in alignment with each other. Depending on the structure of the switch arrangement, and according to the requirements, each camshaft may have two or more cam discs arranged coaxially and spaced a distance from each other. The distance is determined by the thickness of the switch elements, taking into consideration intermediate spaces.

An example of the invention is shown in the drawings and explained as follows.

DETAILED DESCRIPTION OF THE INVENTION

Figure 1:
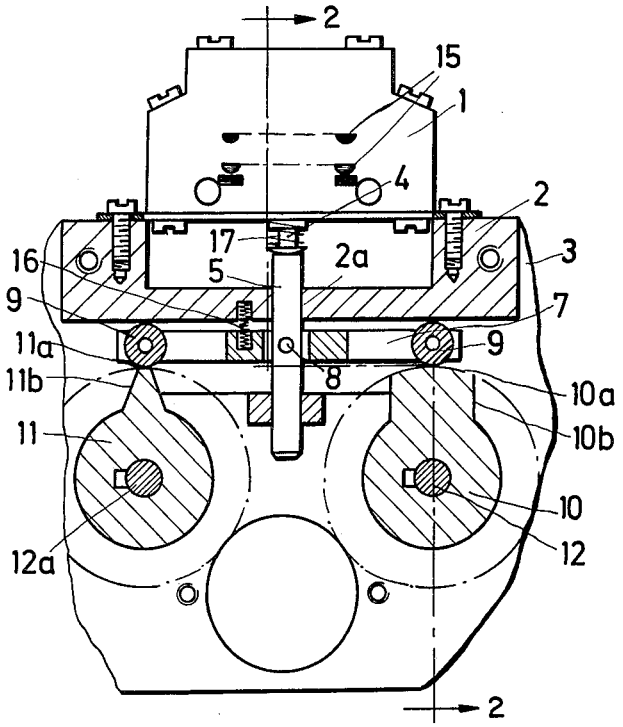
FIG. 1 is a front elevational view of switch apparatus partially in section illustrating the invention.
Figure 2:
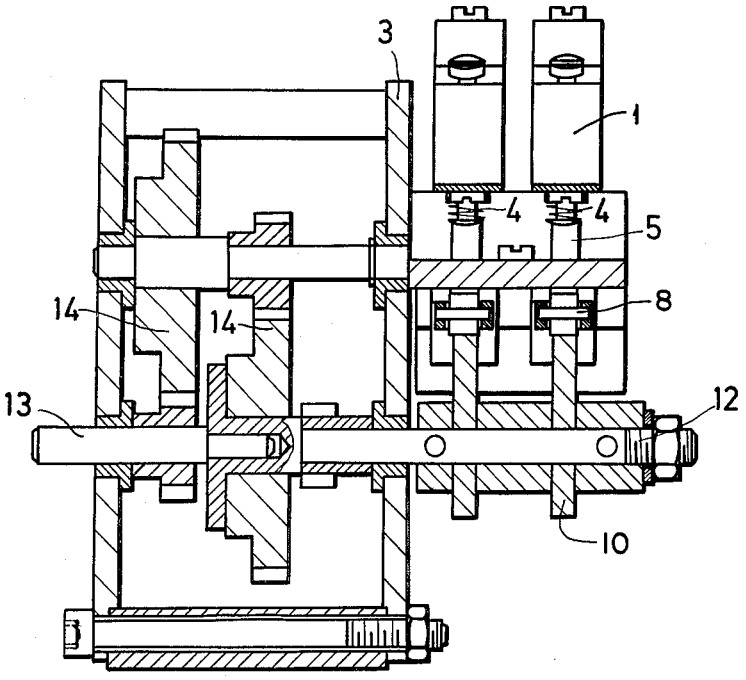
FIG. 2 is a cross sectional view of the apparatus shown in FIG. 1, taken along lines 2—2 of FIG. 1.

FIGS. 1 and 2 show two switch elements 1 provided with switch contacts 15 on a panel. The latter is attached to a base plate 3, and is provided with boreholes 2*a* to guide thrust rods 5 which carry, via rotary bearings 8, toggle levers 7 provided with cam followers 9. The latter are maintained at all times by springs at a slight distance to the cam discs 10 and 11. Rotary bearing 8 shown in FIG. 1 and FIG. 2 consists of a cylindrical pin guided through thrust rod 5, on which toggle lever 7 is pivotally or tiltably positioned. A circular-shaped shoulder projects over and under the protruding cylindrical pin. In this manner, the cylindrical pin supports the toggle lever 7 while allowing the thrust rod to move upwardly and downwardly as the ends of the toggle lever 7 move. Cam followers 9 are in the nature of small roller elements, i.e., they have smooth cylindrical outside surfaces. The cylindrical surface, best seen in FIG. 1, rolls over the limit surfaces 10*b* and 11*b*, the switch surface 10*a* and the rest surface 11*a* of the cam discs 10 and 11. Cam followers 9 are rotatably supported on toggle lever 7 by simple shafts passing through the cam followers. The shafts are either fixedly or rotatably secured to the toggle lever 7. The followers 9 adhere to the limit surfaces 10*b* and 11*b*, as well as to the switch surfaces 10*a*, and the rest surfaces 11*a*, if in active position. The switch surfaces 10*a* and the adjacent and subsequent limit surfaces 10*b* are parts of the fast-revolving cam discs 10. The switch surfaces 10*a* each extend over an arc of about 45°. The slowly revolving cam discs 11 have protruding rest surfaces 11*a*.

FIG. 1 shows the switch apparatus in switch position, with cam followers 9 of the toggle levers 7 resting on the switch surfaces 10*a* and the rest surfaces 11*a*. As best seen in FIG. 1, the toggle lever 7 is biased downwardly such that the cam followers 9 ride on the surfaces of the cam discs 10 and 11. The downward bias is accomplished by spring 16 which has one end embedded in the top of lever 7 and has its other end projecting into a cylindrical recess located in a cross member of the switch elements 1. This maintains the thrust rod 5 and the tappets 4 with their switch contacts 15 in the opened position shown in broken line. The closed position of the switch contacts 15 is represented by a dash-dot line. The tappets 4 are charged by springs 17 to be always in the closed position of the switch contacts 15, so that the contacts are actually closed when the switch surfaces and rest surfaces yield. If a toggle lever is activated by one of its two switch points only, the thrust rod 5 is not moved.

FIG. 2 shows the power transmission from the drive shaft 13 reduced to the camshaft 12 of the fast-revolving cam disc 10, and via the transmission gearing 14 with its various gear pinions, some of which are not shown, to the camshaft 12*a* of the slowly revolving cam disc 11.

I claim:

1. Switching apparatus for deactivating a drive, comprising (a) a drive shaft for said drive;

(b) a switch contact for deactivating said drive;

(c) a first camshaft;

(d) a second camshaft;

(e) gear reduction means connecting said drive shaft to said first and second camshafts;

(f) a cam positioned on each said first and second camshaft; the improvement characterized by (g) said first camshaft is driven slowly through said gear reduction means;

(h) said second camshaft is driven rapidly through said gear reduction means;

(i) a toggle lever having two ends;

(j) a thrust rod being mechanically connected to said switch contact and said toggle lever, said thrust rod being located between the ends of said toggle lever;

(k) a short activating surface on said cam on said first camshaft for engaging one end of said toggle lever; and (l) a long activating surface on said cam on said second camshaft for engaging the opposite end of said toggle lever;

(m) whereby the simultaneous movement of both ends of said toggle lever onto said short and long activating surfaces causes said thrust rod to engage said switch contact.

2. The apparatus of claim 1, further characterized by (a) the said long activating surface is a central angle of 45°.

3. The apparatus of claim 1, further characterized by (a) cam follower means on each end of said toggle lever for engaging said cams.

4. The apparatus of claim 1, further characterized by (a) first spring means for urging said toggle lever against said cams.

5. The apparatus of claim 1, further characterized by (a) a tappet positioned between said thrust rod and said switch contact; and (b) said tappet spaced from said thrust rod in the closed position of said switch contact.

6. The apparatus of claim 1, further characterized by (a) the said gear reduction means has a transmission ratio of 20:1.

7. The apparatus of claim 1, further characterized by (a) said first and second camshafts are parallel.

8. The apparatus of claim 7, further characterized by (a) the said cams positioned on said first and second camshafts are aligned with each other.

9. The apparatus of claim 1, further characterized by (a) a plurality of cams spaced apart along said first and said second camshafts.

* * * * *